US011631349B2

(12) United States Patent
Robl

(10) Patent No.: US 11,631,349 B2
(45) Date of Patent: Apr. 18, 2023

(54) LIGHT BOX AND LIGHT BOX GROUP THEREWITH

(71) Applicant: SLL Service GmbH, Cologne (DE)

(72) Inventor: Thomas Robl, Cologne (DE)

(73) Assignee: SLL SERVICE GMBH, Cologne (DE)

( * ) Notice: Subject to any disclaimer, the term of this patent is extended or adjusted under 35 U.S.C. 154(b) by 103 days.

(21) Appl. No.: 17/434,053

(22) PCT Filed: Feb. 28, 2020

(86) PCT No.: PCT/EP2020/055278
§ 371 (c)(1),
(2) Date: Aug. 26, 2021

(87) PCT Pub. No.: WO2020/174083
PCT Pub. Date: Sep. 3, 2020

(65) Prior Publication Data

US 2022/0139276 A1 May 5, 2022

(30) Foreign Application Priority Data

Feb. 28, 2019 (DE) ..... 10 2019 105 068.5

(51) Int. Cl.
*G09F 13/04* (2006.01)
*G09F 13/22* (2006.01)

(52) U.S. Cl.
CPC ..... *G09F 13/0463* (2021.05); *G09F 13/0404* (2013.01); *G09F 13/0413* (2013.01); *G09F 2013/222* (2013.01)

(58) Field of Classification Search
CPC ..... G09F 13/0463; G09F 13/0404; G09F 13/0413; G09F 2013/222
See application file for complete search history.

(56) References Cited

U.S. PATENT DOCUMENTS 5,461,808 A 10/1995 Fritts
6,323,832 B1 * 11/2001 Nishizawa ..... G09F 13/22 313/500

(Continued)

FOREIGN PATENT DOCUMENTS

CN 106 157 845 11/2016
DE 202 02 855 6/2002

(Continued)

OTHER PUBLICATIONS

Office action issued in Canadian family member No. 3,126,453, Office action dated Nov. 3, 2022.

(Continued)

*Primary Examiner* — Gary C Hoge
(74) *Attorney, Agent, or Firm* — Greenblum & Bernstein, P.L.C.

(57) ABSTRACT

A light box having a front part and a rear part. The front part, a printable, translucent, and rollable front plastics plate, forms a front side with a perimeter edge. The front part has a peripheral first connecting strip fixed on the front plastics plate to extend at least substantially along the entire perimeter edge of the front plastics plate. The rear part has a rollable rear plastics plate forming the rear side with a perimeter edge. The rear part has a peripheral second connecting strip fixed on the rear plastics plate to extend at least substantially along the entire perimeter edge of the rear plastics plate. At least one electrical light-emitting unit is arranged on an inside of the rear plastics plate opposite the rear side. The front part is fixed in front of the rear part by the first and second connecting strips.

14 Claims, 6 Drawing Sheets

(56) References Cited

U.S. PATENT DOCUMENTS

| | | | | |
|---|---|---|---|---|
| 6,400,247 | B1 * | 6/2002 | King | B65D 85/00 220/8 |
| 2006/0162202 | A1 | 7/2006 | Landry | |
| 2011/0096531 | A1 * | 4/2011 | Frey | G02F 1/133608 362/97.4 |
| 2016/0076708 | A1 * | 3/2016 | Shirilla | F21K 9/20 362/235 |
| 2017/0123273 | A1 * | 5/2017 | Kim | G02F 1/133603 |
| 2019/0278095 | A1 * | 9/2019 | Pan | F21V 15/012 |
| 2019/0385493 | A1 * | 12/2019 | Lei | G09F 13/22 |
| 2020/0312202 | A1 * | 10/2020 | Miller | G09F 15/0062 |
| 2022/0136676 | A1 * | 5/2022 | An | F21V 17/101 362/311.01 |

FOREIGN PATENT DOCUMENTS

| | | | |
|---|---|---|---|
| DE | 20 2006 006 889 | | 9/2006 |
| DE | 699 32 233 | | 6/2007 |
| DE | 20 2007 018 388 | | 7/2008 |
| DE | 20 2018 104 102 | | 8/2018 |
| DE | 10 2017 114 925 | | 1/2019 |
| JP | 09-289390 | A | 11/1997 |
| JP | 2011-034674 | A | 2/2011 |
| JP | 2017-016870 | A | 1/2017 |

OTHER PUBLICATIONS

Office action of the Japan Patent and Trademark Office, dated Jun. 7, 2022, for Japanese Patent Application No. 2021-541720, along with an English language translation.

Office Action issued in German Counterpart Patent Appl. No. 10 2019 105 068.5, dated Dec. 5, 2019.

Office Action issued in German Counterpart Patent Appl. No. 10 2019 105 068.5, dated Jun. 8, 2021.

International Search Report issued in International Patent Application No. PCT/EP2020/055278, dated Jul. 1, 2020, along with an English translation thereof.

Written Opinion of the International Searching Authority issued in International Patent Application No. PCT/EP2020/055278, dated Jul. 1, 2020, along with an English translation thereof.

* cited by examiner

LIGHT BOX AND LIGHT BOX GROUP THEREWITH

The invention relates to a light box as claimed in claim 1 and to a light box group having at least two such light boxes as claimed in claim 14.

Light boxes are used to illuminate an information carrier from behind in order to highlight the information on the information carrier, to make it legible in the dark, or simply to make a higher quality impression than, for example, a poster. Nowadays, they form an intermediate stage, as it were, between posters as simple presentation options on the one hand and flat screens on the other.

For example, DE 20 2006 006 889 U1 discloses a light box for the presentation of translucent printed films or photographic slides. A light box housing having an interior is formed from aluminum profile strips and a rear wall. A light source sits in the interior. Hook-and-loop fastening strips for fixing the films or slides or for a light-transmissive cover pane are arranged on a front side of the light box housing, in the region of the aluminum profile strips.

This embodiment has a relatively complex structure and is therefore relatively expensive to produce. For use as an information and advertising space, the weight is also not insignificant, because the light box often has to be carried and set up at short notice.

The object is therefore to overcome the disadvantages of the prior art and to create a light box for an information and advertising space that is inexpensive and easy to set up and transport.

Main features of the invention are specified in claim 1 and claim 14. Refinements are the subject matter of claims 2 to 13.

The invention relates to a light box having a front part with a front side and a rear part with a rear side. The front part has a printable, translucent, and rollable front plastics plate, which forms the front side and has a perimeter edge. In addition, the front part has a peripheral first connecting strip, which is fixed on the front plastics plate and which extends at least substantially (or completely) along the entire perimeter edge of the front plastics plate. The rear part in turn has a rollable rear plastics plate, which forms the rear side and which has a perimeter edge. In addition, the rear part has a peripheral second connecting strip, which is fixed on the rear plastics plate and which extends at least substantially (or completely) along the entire perimeter edge of the rear plastics plate. At least one electrical light-emitting unit is arranged on an inside of the rear plastics plate opposite the rear side. The front part in this case is able to be fixed in front of the rear part by way of the first and second connecting strips.

Due to their rollable properties, the front part and the rear part can be easily stowed away by being rolled up. The light box can thus be transported easily and is also suitable for short-term decoration of presentation areas such as exhibitions or trade fairs. The front plastics plate should be printed, for example with a motif, a logo, and/or text. The rear part can be combined with differently printed front parts.

According to a more detailed refinement of the invention, the front part is able to be reversibly formed into a roll by rolling up the front plastics plate. This allows the front part to be packed up compactly and to be easily transported.

According to a further, more detailed refinement, the rear part is able to be reversibly formed into a roll by rolling up the rear plastics plate. This allows the rear part to be packed up compactly and to be easily transported.

In a variant, the front part and the rear part are able to be reversibly formed, with one lying on top of the other, into a roll by rolling up the front and rear plastics plates together. This enables the light box to be transported in a particularly space-saving manner.

The light box preferably has a packaging tube for stowing the roll(s). This avoids impact damage caused by transport, in particular to the plastics plates.

In one embodiment, the fixing of the front part in front of the rear part by way of the first and second connecting strips is a connection that is releasable without damage. Consequently, the light box can be set up and taken down repeatedly.

According to a particular embodiment, the first and second connecting strips are flexible or elastically deformable, in particular in a manner such that the front part and/or the rear part can be rolled up in the longitudinal direction of the first and/or second connecting strip. Optionally, the connecting strips, which extend transversely to the rolling direction, can be designed to be (more) rigid. This makes it possible to achieve a high level of rigidity of the light box.

In one refinement version, the fixing of the front part in front of the rear part comprises direct contact between the first and second connecting strips. As a result, a connection between the first and second connecting strips that is releasable without damage can be based, for example, on adhesion, in particular on van der Waals forces. For example, the adhesion can be brought about by forming the first and/or second connecting strip with polyvinyl chloride, polyethylene, silicone, or poly(organo)siloxanes. According to an alternative, the connection between the first and second connecting strips, which is releasable without damage, can be brought about by designing them in the form of hook-and-loop fastening.

According to another version, the fixing of the front part in front of the rear part comprises a spacer between the first and second connecting strips, for example the front plastics plate, the rear plastics plate, or a profile bar. In this way, the connecting strips can be concealed or be arranged on the outside. A picture frame, for example, could be formed with an arrangement on the outside. With the aid of a profile bar as a spacer, it is possible to provide structural reinforcement. However, a particularly high level of transport convenience is achieved with variants that do not have any rigid structural elements for setting up the light box.

Furthermore, there is the option that the connection between the first and second connecting strips, which is releasable without damage, can be based on magnetism. This is particularly convenient to use, among other things because magnets are suitable for encouraging centering of the front part relative to the rear part.

It is possible in principle that the first connecting strip can be composed of first strip segments that are lined up one behind the other. This makes the assembly easier and allows the exact positioning of magnetic effective partners. In addition, defined gaps can be provided between strip segments, e.g. for a cable feed-through.

It is equally possible for the second connecting strip to be composed of second strip segments that are lined up one behind the other.

In order to form the connection that is based on magnetism and is releasable without damage, the first connecting strip and/or the second connecting strip should be magnetized at least in sections. The other strip from the group of first connecting strip and second connecting strip can optionally be magnetizable at least in sections (but not magnetized).

In a particular embodiment, the first and/or the second connecting strip is a magnetic strip, and the other from the group of the first and second connecting strips is a magnetic strip or a magnetizable strip.

The first and/or the second connecting strip are preferably adhesively bonded or welded to the first and second plastics plate, respectively. This means that they are permanently and stably fixed.

A high dimensional stability of the light box is achieved if the connection between the first and second connecting strips, which is releasable without damage, is formed substantially around the perimeter. This also avoids gaps and interstices, through which light from the light-emitting unit could emerge.

The light box is preferably cuboid. To this end, the front side and the rear side are preferably of the same size, preferably rectangular and preferably planar when in use.

In a particular embodiment, the front plastics plate is foldable using folding lines to form a box-like body, wherein the box-like body has, adjacent to the front side, side parts on which the first connecting strip is fixed. In this way, visually appealing side surfaces can be provided and, in addition, a deeper light box having a high degree of dimensional stability is obtained. This can be accomplished, for example, in that the front plastics plate is rectangular with four side edges, wherein, adjacent to the four side edges, in each case a folding line for forming a side part extends, wherein the four side parts are able to be brought into a position standing perpendicularly away from the front side along the folding lines in order to fix the front part in front of the rear part. It is preferred in that case that the side parts of the front plastics plate have a uniform width orthogonal to the respective folding line. The width of the first connecting strip can correspond at least substantially to the width of the side parts of the front plastics plate. In particular, it can be slightly smaller. This results in a stabilization of the side parts, and a sharp kink along the folding line is supported. This also avoids undulations on the front side. It is practical to design the folding lines with an embossing or a material weakening. This makes exact folding easier. The corners should be cut out or form a flap that is able to be folded over.

Optionally, it is possible for the rear plastics plate to be foldable using folding lines to form a box-like body, wherein the box-like body has, adjacent to the rear side, side parts on which the second connecting strip is fixed. This means that the rear part is dimensionally stable as soon as the side parts are erected. For example, the rear plastics plate can be rectangular with four side edges, wherein, adjacent to the four side edges, in each case a folding line for forming a side part extends, wherein the four side parts are able to be brought into a position standing perpendicularly away from the rear side along the folding lines in order to fix the front part in front of the rear part. The side parts of the rear plastics plate preferably have a uniform width orthogonal to the respective folding line. This allows a box-like body having a uniform height to be folded. It is practical to design the folding lines with an embossing or a material weakening. This makes exact folding easier. The width of the second connecting strip should advantageously correspond at least substantially to the width of the side parts of the rear plastics plate. In particular, it can be slightly smaller. This results in a stabilization of the side parts, and a sharp kink along the folding line is supported by the second connecting strip.

If the front plastics plate also has the optional folding lines, a refinement in which the width of the side parts of the front plastics plate corresponds at least substantially to the width of the side parts of the rear plastics plate is preferred. After folding the side parts, two box-like bodies are obtained as a result, which at least substantially have the same shape and can be placed one inside the other. After these box-like bodies have been put together, a closed box-like body in which the light-emitting unit is arranged is created. However, it is not necessary to first fold the two box-like bodies in chronological order. It is just as possible to fix individual side parts to one another by way of the connecting strips and to gradually bring one side part after the other into position. Only in the end result do two box-like bodies then lie one inside the other, without them having been individually present beforehand.

In a specific embodiment, the side parts of the front plastics plate are arranged in a state of use on the outside of the side parts of the rear plastics plate. In this way, a visually appealing edge is provided on the perimeter of the front side, from which no stray light can emerge either.

Furthermore, it is optionally possible for the first connecting strip to be fixed on an inside of the front plastics plate opposite the front side. Consequently, it lies in a non-visible region when the front part is fixed in front of the rear part. It is thus also arranged closer to the second connecting strip and can accordingly form a stronger connection.

In one version of the light box, the rear plastics plate is opaque and/or lightproof. This means that the light box can in particular also be set up freely without disturbing background light being able to escape, without the inner workings of the light box being visible, and without uneven lighting of the front side due to the rear-side incidence of light and shading occurring.

A preferred feature of the light box is that the light-emitting unit has LEDs distributed over the rear side. This saves energy and, in addition, uniform lighting of the front side is achieved even with a flat construction of the light box. In addition, LEDs (light-emitting diodes) are usually so small that they hardly interfere when the rear part is rolled up. According to a preferred variant, the light-emitting unit is formed by LED strips. These can be rolled up as an individual part and consequently do not cause much disruption when rolling up the rear plastics plate, even after being fixed on the rear plastics plate. Alternatively, however, LED rails could also be used, provided they are fixed on the rear plastics plate transversely to the rolling direction of the latter.

The light box can optionally have a suspension device, for example a hook holder such as an eyelet or a recess, or a suspension cord. The suspension device is preferably arranged on the rear part and here preferably on the rear side of the rear plastics plate. The light box can be suspended with a suspension device, for example can be hung on a wall. As an alternative or in addition, it is possible for the light box to have a stand. Such a stand can for example be arranged at or attached to the front and/or the rear plastics plate. With a stand, the light box can be set up freely in the space, e.g. on a table.

The invention additionally relates to a light box group having at least two light boxes as described above and below, wherein the light boxes adjoin one another in an adjacent fashion in such a way that the front sides of the two light boxes are arranged next to one another, wherein the light boxes are fixed to one another by way of a connection that is releasable without damage, preferably by way of their first and/or second connecting strips. This makes it possible to provide a large presentation area that can be easily dismantled into its individual parts for transport. It is possible that the front parts and the rear parts of a plurality of light boxes are all rolled up together to form a common roll for transport.

Further features, details and advantages of the invention become apparent from the wording of the claims and from the following description of exemplary embodiments with reference to the drawings, in which:

Figure 1:
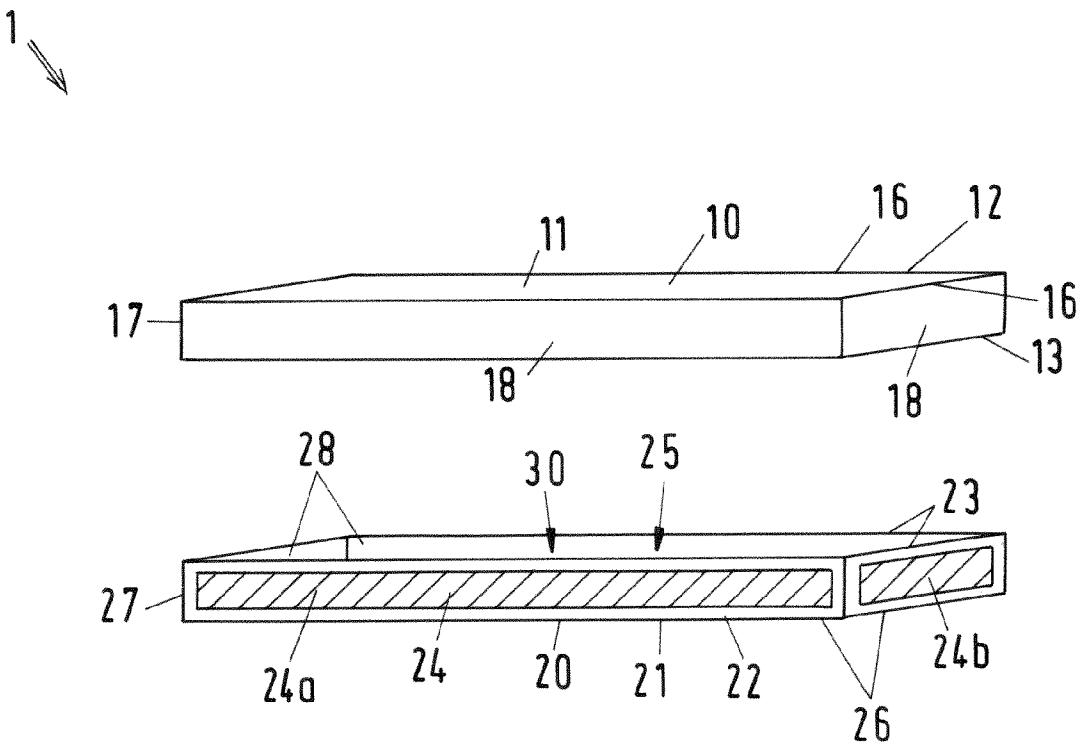
FIG. 1 shows a schematic perspective view of a light box, wherein a front part is being shown lifted up from a rear part.

FIG. 1 shows a light box 1 in a schematic perspective view. The light box has a front part 10 with a rectangular front side 11 and a rear part 20 with a rectangular rear side 21.

The front part 10 is shown lifted up from the rear part 20. The main element of the front part 10 is a printable, translucent, and rollable front plastics plate 12, which forms the front side 11 and which has a perimeter edge 13. The front plastics plate 12 can be printed, for example with a motif, a logo and/or text. Furthermore, the front plastics plate 12 is folded using folding lines 16 to form a box-like body 17 having side parts 18. It cannot be seen from this perspective that a first connecting strip (cf. reference sign 14 in FIGS. 2 and 3) is fixed on the side parts 18. The front side 11 adjoins the side parts 18 along the folding lines 16, wherein the side parts are brought into a position standing perpendicularly away from the front side 11 along the folding lines 16 in order to fix the front part 10 in front of the rear part 20.

Figure 2:
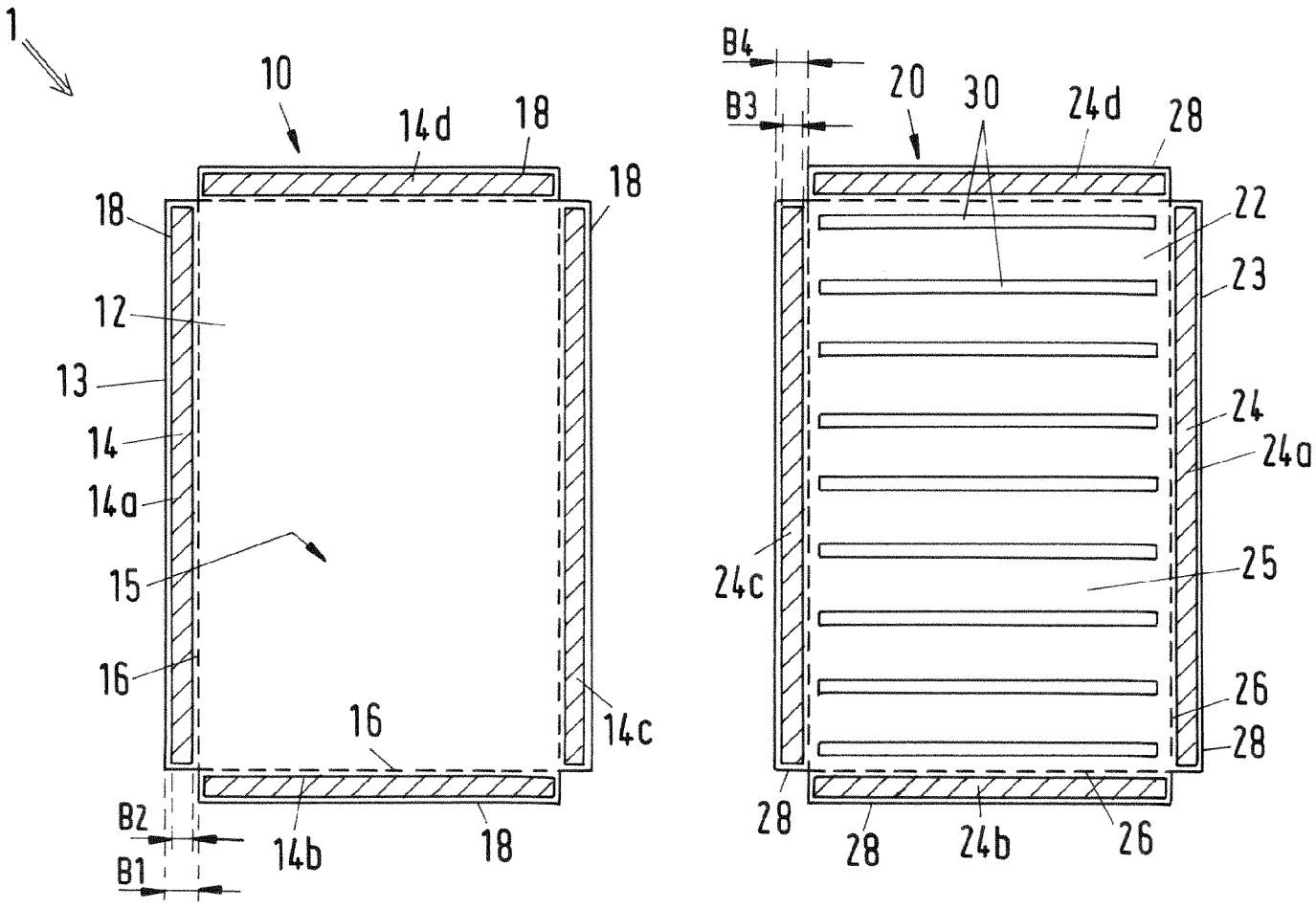
FIG. 2 shows a schematic view of a light box, wherein a front part and a rear part are shown lying next to one another.

The four side parts 18 of the front plastics plate 12 have a uniform width B1 orthogonal to the respective corresponding folding line 16, as can be seen in particular in FIG. 2. The corners between the four side parts 18 are each cut out. FIG. 2 also shows that the peripheral first connecting strip 14 of the front part 10 is fixed on an inside 15 of the front plastics plate 12 opposite the front side 11 and extends at least substantially along the entire perimeter edge 13 of the front plastics plate 12. The first connecting strip 14 is flexible or elastically deformable and is composed of four first strip segments 14*a*, 14*b*, 14*c*, 14*d*, which are lined up one behind the other and each fixed on one of the four side parts 18. The first connecting strip 14 is a magnetic strip. The width B2 of the first connecting strip 14 is slightly smaller than the width B1 of the side parts 18, with the result that the widths B1, B2 substantially correspond.

The rear part 20 according to FIGS. 1 and 2 has a rollable rear plastics plate 22, which forms the rear side 21. The rear plastics plate 12 is opaque and/or light-proof and has a perimeter edge 23. In addition, the rear part 20 has a peripheral second connecting strip 24, which is fixed on the rear plastics plate 12, in particular on the rear side 21 according to FIG. 1 and, in deviation from this, on an inside 25 of the rear plastics plate 22 opposite the rear side 21 in FIG. 2. The second connecting strip 24 extends at least substantially along the entire perimeter edge 23 of the rear plastics plate 22.

According to FIG. 1, the rear plastics plate 22 is folded using folding lines 26 to form a box-like body 27, wherein the box-like body 27 has, adjacent to the rear side 21, side parts 28 on which the second connecting strip 24 is fixed. According to FIG. 2, the side parts 28 lie in the plane with the rear side 21. The corners between the four side parts 28 are each cut out. In particular, the rear plastics plate 22 is rectangular with four side edges, wherein, adjacent to the four side edges, in each case a folding line 26 for forming the side parts 28 extends, wherein the four side parts 28 are able to be brought into a position standing perpendicularly away from the rear side 21 along the folding lines 26 in order to fix the front part 10 in front of the rear part 20. The side parts 28 of the rear plastics plate 22 have a uniform width B3 orthogonal to the respectively corresponding folding line 26. The width B4 of the second connecting strip 24 is slightly smaller than the width B3 of the side parts 28 and thus at least substantially corresponds to this width B3 of the side parts 28. At the same time, the width B1 of the side parts 18 of the front plastics plate 12 corresponds at least substantially to the width B3 of the side parts 28 of the rear plastics plate 22.

The second connecting strip 24 is flexible or elastically deformable and is composed of four second strip segments 24*a*, 24*b*, 24*c*, 24*d*, which are lined up one behind the other and each fixed on one of the side parts 28 of the rear part 20. The second connecting strip 24 is also a magnetic strip.

Furthermore, an electrical light-emitting unit 30 consisting of LEDs distributed over the rear side 21 is fixed on the inside 25 of the rear plastics plate 22. The light-emitting unit 30 is, in particular, LED strips that extend parallel to one another.

Figure 3:
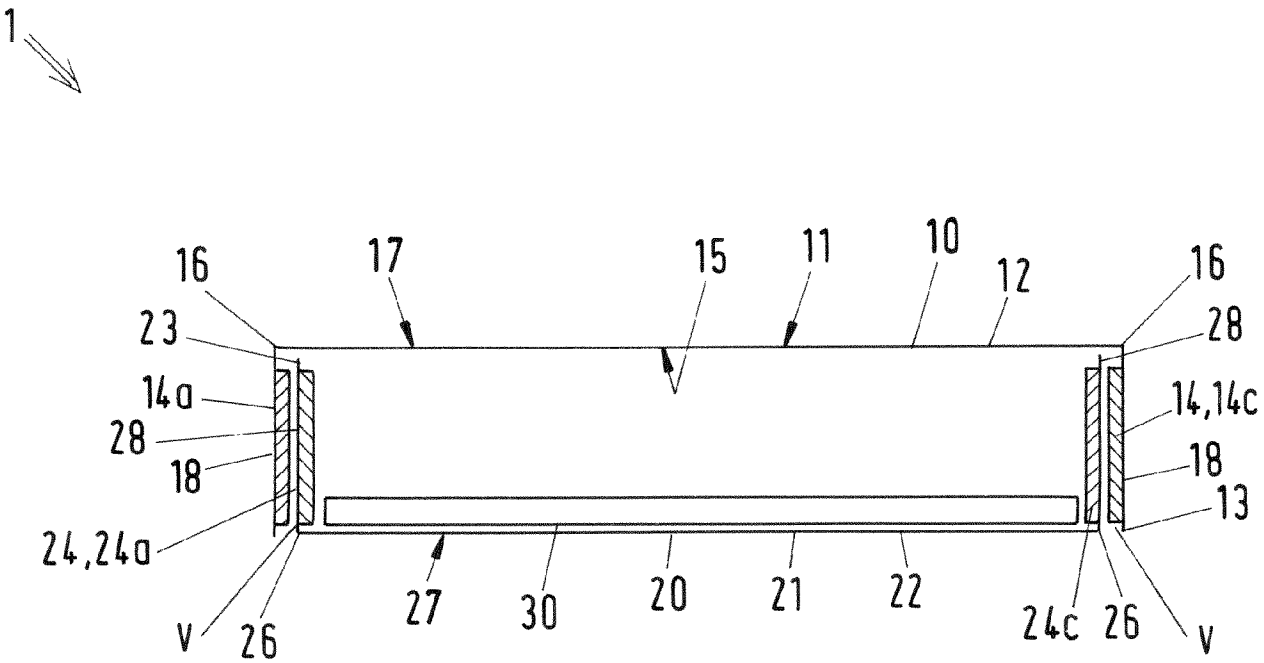
FIG. 3 shows a schematic cross section through a light box.

How the front part 10 and the rear part 20 according to FIG. 2 can be assembled can be seen from the schematic cross section according to FIG. 3. Here, the front part 10 is fixed in front of the rear part 20 by way of the first and second connecting strips 14, 24. In this assembly, the side parts 18 of the front plastics plate 12 lie on the outside of the side parts 28 of the rear plastics plate 22.

With an arrangement of the second connecting strip 24 as shown in FIG. 1, it would theoretically be possible that the fixing of the front part 10 in front of the rear part 20 comprises direct contact between the first and second connecting strips 14, 24. According to the variant according to FIGS. 2 and 3, however, the fixing of the front part 10 in front of the rear part 20 comprises a spacer between the first and second connecting strips 14, 24, with the spacer being the rear plastics plate 22 and in particular its side parts 28.

The fixing of the front part 10 in front of the rear part 20 by way of the first and second connecting strips 14, 24, here both magnetic strips, makes a connection V possible that is releasable without damage and is based on magnetism. In the case of an arrangement according to FIG. 1, adhesion or a hook-and-loop fastening connection could be used as a connection V between the first and second connecting strips 14, 24, which is releasable without damage.

The extension of the connecting strips 14, 24 almost completely along the side parts 18, 28 results in a connection V between the first and second connecting strips 14, 24, which is releasable without damage and extends at least substantially around the perimeter.

Figure 4:
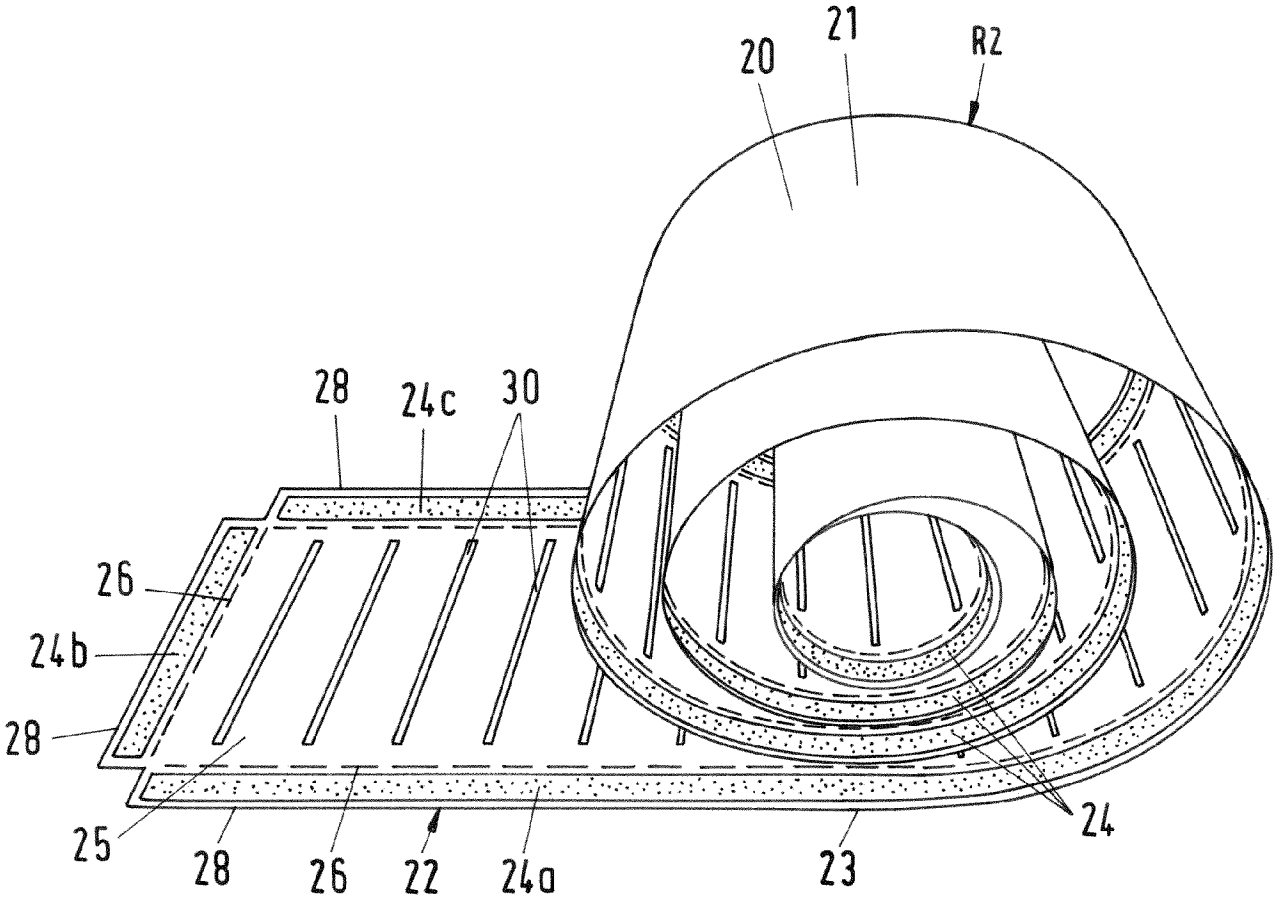
FIG. 4 shows a schematic perspective view of a rear part of a light box, which is being rolled up to form a roll.

FIG. 4 shows a schematic perspective view of a rear part 20 of a light box, which is being rolled up to form a roll R2. With regard to the technical features, this rear part 20 corresponds to the refinement according to FIG. 2, for which reason reference is made to the passages of the description belonging to FIG. 2 in order to avoid repetition. As can be seen, the LED strips of the light-emitting unit 30 extend transversely to the rolling direction.

Figure 5:
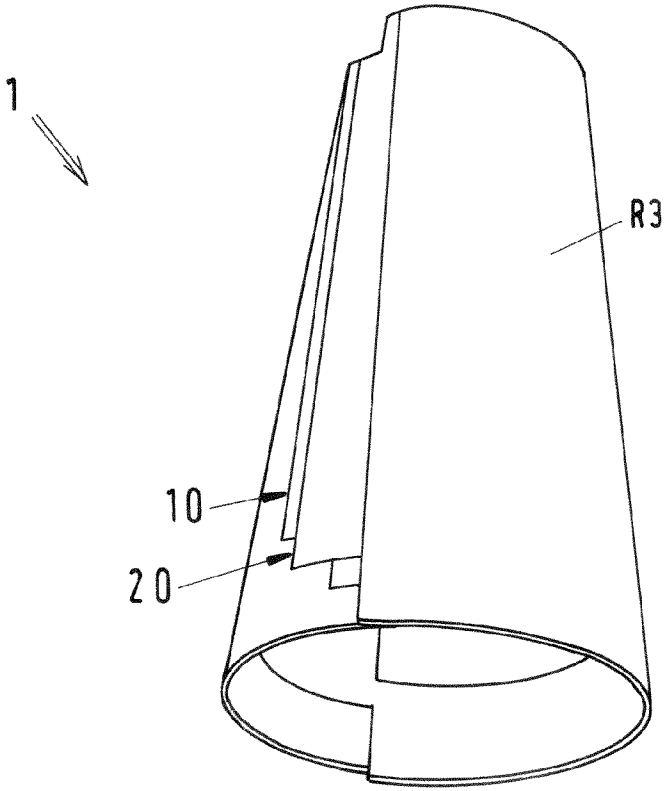
FIG. 5 shows a schematic perspective view of a light box, wherein its front part and its rear part are being rolled up together to form a roll.

FIG. 5 shows a schematic perspective view of a light box 1, which, however, is not mounted. Rather, its front part 10 and its rear part 20 are rolled up together, lying one on top of the other, to form a roll R3.

Figure 6:
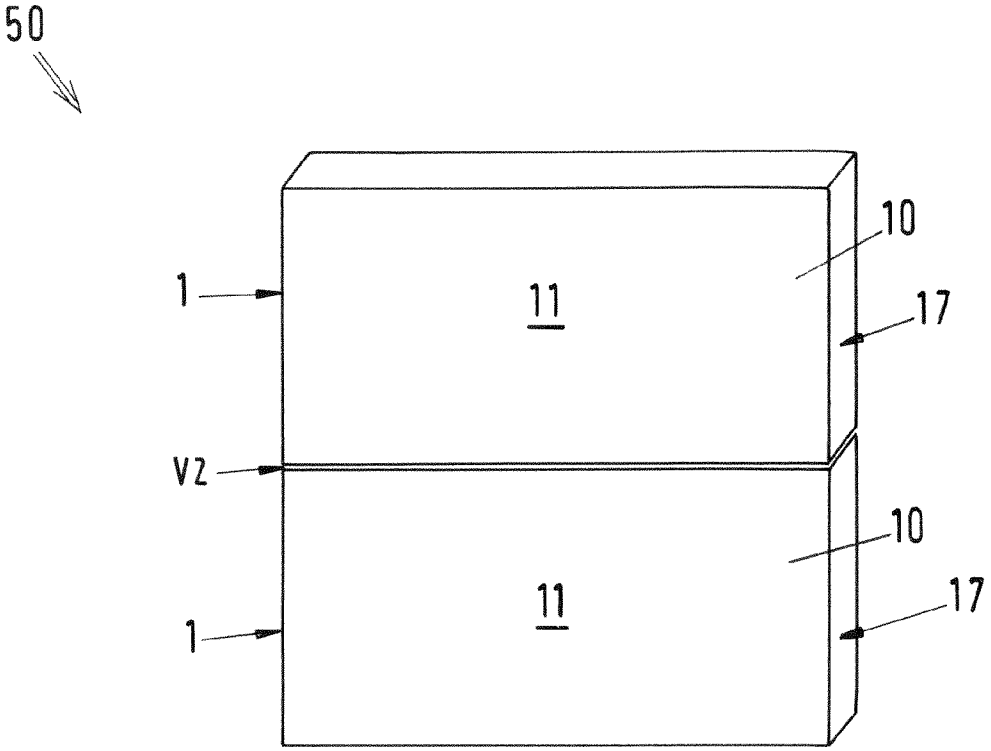
FIG. 6 shows a schematic perspective view of a light box group having two light boxes.

FIG. 6 shows a schematic perspective view of a light box group 50 having two light boxes 1. The two light boxes 1 adjoin one another in an adjacent manner in such a way that the front sides 11 of the two light boxes 1 are arranged next to one another. By way of their first and second connecting strips 14, 24, both magnetic strips, the light boxes 1 are fixed to one another via a connection V2, which is releasable without damage.

The invention is not restricted to one of the embodiments described above, but can be modified in a wide variety of ways.

All of the features and advantages, including structural details, spatial arrangements, and method steps, arising from the claims, the description, and the drawing may be essential to the invention, both individually and in a wide variety of combinations.

LIST OF REFERENCE SIGNS

| | |
|---|---|
| 1 | Light box |
| 10 | Front part |
| 11 | Front side |
| 12 | Front plastics plate |
| 13 | Perimeter edge |
| 14 | First connecting strip |
| 14a | First strip segment |
| 14b | First strip segment |
| 14c | First strip segment |
| 14d | First strip segment |
| 15 | Inside |
| 16 | Folding lines |
| 17 | Box-like body |
| 18 | Side parts |
| 20 | Rear part |
| 21 | Rear side |
| 22 | Rear plastics plate |
| 23 | Perimeter edge |
| 24 | Second connecting strip |
| 24a | Second strip segment |
| 24b | Second strip segment |
| 24c | Second strip segment |
| 24d | Second strip segment |
| 25 | Inside |
| 26 | Folding lines |
| 27 | Box-like body |
| 28 | Side parts |
| 30 | Electrical light-emitting unit |
| 50 | Light box group |
| B1 | Width of the side parts of the front plastics plate |
| B2 | Width of the first connecting strip |
| B3 | Width of the side parts of the rear plastics plate |
| B4 | Width of the second connecting strip |
| R2 | Roll |
| R3 | Roll |
| V | Connection that is releasable without damage |
| V2 | Connection that is releasable without damage |

The invention claimed is:

1. A light box comprising:

a front part with a front side; and a rear part with a rear side, wherein the front part has a printable, translucent, and rollable front plastics plate, which forms the front side and has a perimeter edge, wherein the front part has a peripheral first connecting strip, which is fixed on the front plastics plate and which extends at least substantially along an entire perimeter edge of the front plastics plate, wherein the rear part has a rollable rear plastics plate which forms the rear side and which has a perimeter edge, wherein the rear part has a peripheral second connecting strip, which is fixed on the rear plastics plate and extends at least substantially along an entire perimeter edge of the rear plastics plate, wherein at least one electrical light-emitting unit is arranged on an inside of the rear plastics plate opposite the rear side, and wherein the front part is fixable in front of the rear part by way of the first and second connecting strips.

2. The light box as claimed in claim 1, wherein the front part is able to be reversibly formed into a roll by rolling up the front plastics plate.

3. The light box as claimed in claim 1, wherein the rear part is able to be reversibly formed into a roll by rolling up the rear plastics plate.

4. The light box as claimed in claim 1, wherein the first and second connecting strips are flexible or elastically deformable.

5. The light box as claimed in claim 1, wherein a fixing of the front part in front of the rear part comprises direct contact between the first and second connecting strips.

6. The light box as claimed in claim 1, wherein a fixing of the front part in front of the rear part comprises a spacer between the first and second connecting strips.

7. The light box as claimed in claim 1, wherein a fixing of the front part in front of the rear part by way of the first and second connecting strips is a connection that is releasable without damage.

8. The light box as claimed in claim 7, wherein the connection between the first and second connecting strips, which is releasable without damage, is based on magnetism.

9. The light box as claimed in claim 1, wherein the front plastics plate is foldable using folding lines to form a box-like body, wherein the box-like body has, adjacent to the front side, side parts on which the first connecting strip is fixed.

10. The light box as claimed in claim 1, wherein the rear plastics plate is able to be folded using folding lines to form a box-like body, wherein the box-like body has, adjacent to the rear side, side parts on which the second connecting strip is fixed.

11. The light box as claimed in claim 1, wherein the first connecting strip is fixed on an inside of the front plastics plate opposite the front side.

12. The light box as claimed in claim 1, wherein the rear plastics plate is opaque and/or light-proof.

13. The light box as claimed in claim 1, wherein the light-emitting unit has LEDs distributed over the rear side.

14. A light box group comprising:

at least two light boxes as claimed in claim 1, wherein the light boxes adjoin one another in an adjacent manner in such a way that the front sides of the two light boxes are arranged next to one another, wherein the light boxes are fixed to one another by way of a connection that is releasable without damage.

* * * * *